US006286242B1

(12) United States Patent
Klebes

(10) Patent No.: US 6,286,242 B1
(45) Date of Patent: Sep. 11, 2001

(54) SECURITY APPARATUS FOR A FIREARM

(75) Inventor: John F. Klebes, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/595,164

(22) Filed: Jun. 15, 2000

Related U.S. Application Data

(62) Division of application No. 09/206,013, filed on Dec. 4, 1998.

(51) Int. Cl.[7] ..... F41A 19/00
(52) U.S. Cl. ..... 42/84; 42/70.01
(58) Field of Search ..... 42/84, 70.11, 70.01, 42/70.06

(56) References Cited

U.S. PATENT DOCUMENTS

| | | | | |
|---|---|---|---|---|
| 520,468 | | 5/1894 | Wesson . | |
| 3,650,174 | * | 3/1972 | Nelsen | 89/28 |
| 4,467,545 | * | 8/1984 | Shaw | 42/70 |
| 4,793,085 | * | 12/1988 | Surawski et al. | 42/84 |
| 4,970,819 | * | 11/1990 | Mayhak | 42/70.01 |
| 5,052,138 | * | 10/1991 | Crain | 42/1.01 |
| 5,272,828 | | 12/1993 | Petrick et al. . | |
| 5,303,495 | * | 4/1994 | Harthcock | 42/84 |
| 5,502,915 | * | 4/1996 | Mendelsohn et al. | 42/70.11 |
| 5,625,972 | | 5/1997 | Kina et al. . | |
| 5,636,464 | * | 6/1997 | Ciluffo | 42/70.11 |
| 5,704,153 | * | 1/1998 | Kaminski et al. | 42/70.11 |
| 5,755,056 | * | 5/1998 | Danner et al. | 42/84 |
| 5,896,691 | * | 4/1999 | Kaminski et al. | 42/70.11 |
| 5,915,936 | * | 6/1999 | Brentzel | 42/70.11 |

* cited by examiner

*Primary Examiner*—Peter M. Poon
*Assistant Examiner*—M. Thomson
(74) *Attorney, Agent, or Firm*—McCormick, Paulding & Huber LLP

(57) ABSTRACT

The present invention is directed to a security apparatus for a firearm including a frame, a power source, a firing chamber adapted to receive a round of ammunition having a primer oriented adjacent a distal end thereof, and a trigger assembly for selectively initiating communication between an ignition system and the primer. The security apparatus further comprises an authorization device for selectively generating a pass signal indicating that an operator of the firearm is an authorized operator, and a firearm sensor for selectively generating a control parameter signal indicating an operational mode of the firearm. An electronically programmable locking device receives the authorization signal and the control parameter signal, and permits communication between the ignition system and the primer only if the authorization signal generates the pass signal and the control parameter signal indicates the firearm is in a standby mode.

32 Claims, 14 Drawing Sheets

70

SECURITY APPARATUS FOR A FIREARM

CROSS-REFERENCE TO RELATED APPLICATIONS

This application is a division of pending U.S. application Ser. No. 09/206,013, filed Dec. 4, 1998, herein incorporated by reference in its entirety, and further some of the material disclosed herein is disclosed and claimed in the following pending U.S. patent application Ser. No. 09/205,391, filed Dec. 4, 1998, entitled "FIRE CONTROL SYSTEM FOR NON-IMPACT FIRED AMMUNITION", which is commonly assigned to the owner of the present application.

FIELD OF THE INVENTION

This invention pertains generally to firearms, and more particularly to firearms having an integrated security apparatus.

BACKGROUND OF THE INVENTION

In conventional firearms, either a striker or a hammer and firing pin is provided for detonating percussion primers. Although many advances in conventional firearm design have been made over the years, the underlying principle of ignition by impact is based on technology essentially optimized in the last century. Percussion primers in today's ammunition and the complexity of moving parts in a firearm having a mechanical fire control system are key design constraints in implementing significant improvements in safety, performance and reliability using conventional technology.

The complexity of moving parts in a mechanical fire control system is especially problematic in a handgun having multiple chambers, such as a revolver, in which a cylinder is rotatable about its centerline on a center pin, and pivotable on a yoke in order to insert and remove the cartridges.

Although electronic components have been designed into the ignition systems of firearms, generally the electrical components either supplement or displace existing parts of the mechanical firing mechanism. The percussion primer is still detonated in the conventional manner, e.g., by impact from a firing pin or striker. U.S. Pat. No. 4,793,085 Electronic Firing System for Target Pistol, for example, shows a pistol in which a mechanical trigger bar is displaced by a solenoid. U.S. Pat. No. 5,704,153 Firearm Battery and Control Module describes a firearm incorporating a microprocessor in an ignition system for a firearm using conventional percussion primers.

Electronic safety mechanisms have been developed for use in revolvers as well as pistols, as illustrated in U.S. Pat. No. 4,970,819 Firearm Safety System and Method, in which actuation of the firing mechanism is blocked until a grip pattern sensing means on the handgrip of the firearm provides a signal to a microprocessor that corresponds to a prestored grip pattern. Typically, however, the electronic safety system of the '819 patent adds an additional layer of complexity to the revolver, by blocking but not replacing, the conventional mechanical firing mechanism for firing percussion primers.

Electronics have also been designed into ignition systems for firearms that use non-conventional primers and cartridges. U.S. Patent No. 3,650,174 for Electronic Ignition System for Firearms describes an electronic control system for firing electrically primed ammunition. The electronic control of the '174 patent, however, is hard-wired and lacks the multiple sensor interfaces or the programmable central processing unit that is found with the present invention. U.S. Pat. No. 5,625,972 for a Gun With Electrically Fired Cartridge describes an electrically fired gun in which a heat-sensitive primer is ignited by a voltage induced across a fuse wire extending through the primer. U.S. Pat. No. 5,272,828 for Combined Cartridge Magazine and Power Supply for a Firearm shows a laser ignited primer in which an optically transparent plug or window is centered in the case of the cartridge to permit laser ignition of the primer. Power requirements and availability of fused and/or laser ignited primers are problematic however.

U.S. Pat. No. 5,755,056, for Electronic Firearm and Process for Controlling an Electronic Firearm shows a firearm for firing electrically activated ammunition having a round sensor, and a bolt position sensor. The technology of the '056 patent, however, is limited to a firearm with a bolt action.

OBJECT AND SUMMARY OF THE INVENTION

It is one of the objects of the present invention to provide a gun capable of achieving major improvements in performance and safety through the use of an all electronic fire control system that has the capability to interface with a wide variety of safety and fault detection sensors and to integrate the sensor data to verify authorized and safe firing conditions prior to ignition.

It is a further object of the present invention to utilize a security apparatus of a firearm to verify that a proposed operator is authorized to fire the firearm.

It is a further object of the present invention to utilize the security apparatus of a firearm to verify that a plurality of firearm sensor parameters indicate that the firearm is in a firing mode.

It is a further object of the present invention that the security apparatus will not enable firing of the firearm unless the operator is an authorized operator and the firearm is in a firing mode.

It is a further object of the present invention that the security apparatus prohibits generation of a firing signal until it is verified that the operator is an authorized operator and the firearm is in a firing mode.

It is a further object of this invention to provide a firearm with superior performance by eliminating the mechanical forces associated with the mechanical linkages and the impact fired ammunition, which tend to pull the firearm off target.

Another object of the present invention is to provide a firearm having an electronic fire control system with all of the aforementioned safety and diagnostic features that can be implemented in either a pistol, a revolver, or a multiple chambered firearm.

Still another object of the present invention to is provide a firearm of the foregoing type which is adaptable for use with several types of ammunition, including electrically fired, optically fired and other types of direct energy initiated ammunition.

The present invention is directed to a security apparatus for a firearm including a frame, a power source, a firing chamber adapted to receive a round of ammunition having a primer oriented adjacent a distal end thereof, and a trigger assembly for selectively initiating communication between an ignition system and the primer. The security apparatus further comprises an authorization device for selectively generating a pass signal indicating that an operator of the firearm is an authorized operator, and a firearm sensor for selectively generating a control parameter signal indicating an operational mode of the firearm.

An electronically programmable locking device receives the authorization signal and the control parameter signal, wherein the programmable locking device permits communication between the ignition system and the primer only if the authorization signal generates the pass signal and the control parameter signal indicates the firearm is in a standby mode.

DETAILED DESCRIPTION OF THE PREFERRED EMBODIMENT

Recently developed reliable, chemically conductive, non-impact primers, such as the Conductive Primer Mix™ developed by Remington Arms Company and described in U.S. Pat. No. 5,646,367, are suitable for small arms such as rifles, handguns and shotguns. These non-impact primers have made possible the development of a fully electronic, microprocessor controlled firearm of the present invention. Significant improvement in the reliability and accuracy of powder detonation are achieved by eliminating the requirement for an electromechanical interface between the electronic control and the ammunition. As seen hereinafter, the non-impact primers allow for implementation of a wide range of new safety features, including self-diagnostics, and intelligent sensing of such inputs as biometric authorization, safe firing conditions, and ammunition presence.

Figure 1:
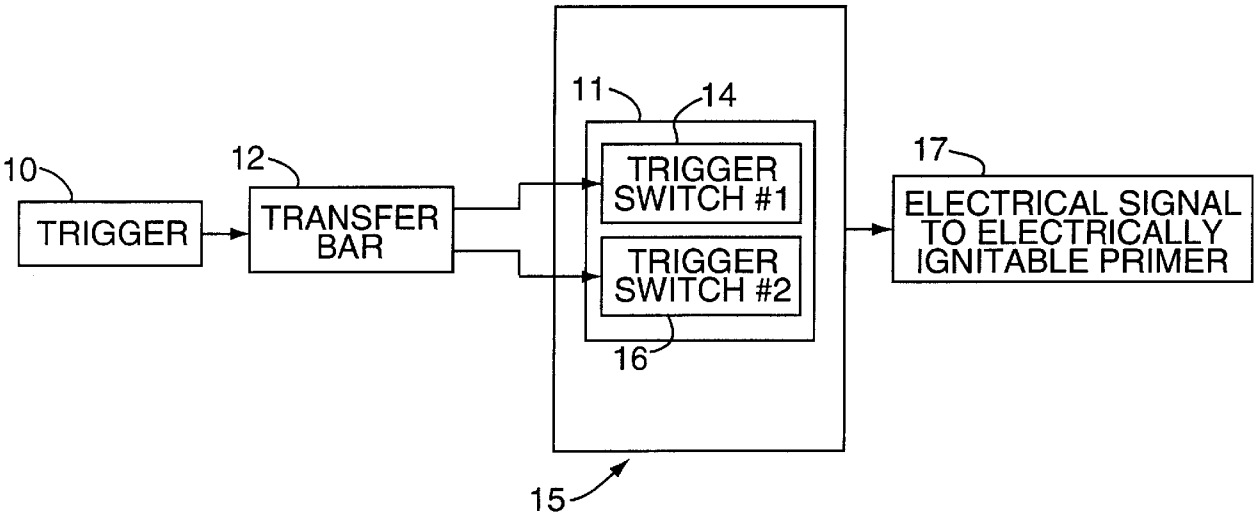
FIG. 1 is a schematic illustration of a firearm used with ammunition having electrically ignitable primer.

Referring to FIG. 1, in a firearm of the present invention, when a trigger 10 is pulled, a transfer bar 12, or equivalent transfer device, activates trigger detection circuitry 11 within an electronic ignition system 15. In the preferred embodiment, the trigger detection circuitry 11 uses two high reliability trigger switches 14,16. The electronic ignition system 15 of the present invention is programmed to deliver an electrical signal 17 to a round of ammunition 5 having a chemically conductive non-impact primer 24 only if safe and authorized firing conditions have been detected.

To simulate the feel of a mechanical trigger, a spring resistance is incorporated into the mechanical linkage between the trigger and the trigger switches. In the preferred embodiment, the spring resistance is a force of 3–4 lbs. over approximately 0.150 to 0.200 inches of trigger travel or until the trigger switches are activated. At the transition point, when the trigger switches are activated, the spring resistance preferably increases to approximately 8 lbs. Other combinations of forces and trigger travel distances may be implemented, depending on the requirements of the user. An additional measure of safety is derived from sensing trigger recovery for a predetermined distance in order to preclude unintentional switching. In the preferred embodiment, double throw switches are used to sense both trigger activation and trigger recovery. Other embodiments, such as the use of an extra switch, may be used to sense trigger recovery.

Figure 2:
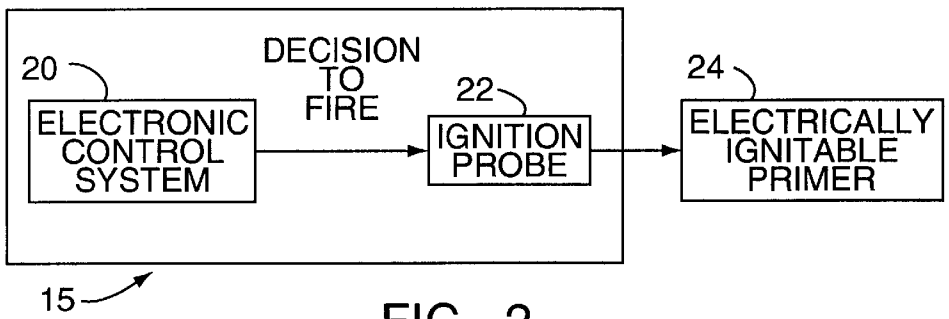
FIG. 2 is a schematic illustration of an ignition system having an electronic control.

As depicted in FIG. 2, the electronic ignition system 15 is comprised of an electronic control system 20, which is the primary subject of the present invention, and an ignition probe 22 that forms the interface between the electronic control system 20 and a non-impact electrically ignitable primer 24 of which the chemically conductive primer referenced above is the preferred embodiment. The electronic control system described herein is readily adaptable for use with other types of non-impact direct energy primers. The ignition probe 22 is the subject of the commonly-owned copending patent application Ser. No. 09/205391, filed Dec 4, 1998, entitled "FIRE CONTROL SYSTEM FOR NON-IMPACT FIRED AMMUNITION", referenced above.

Figure 3:
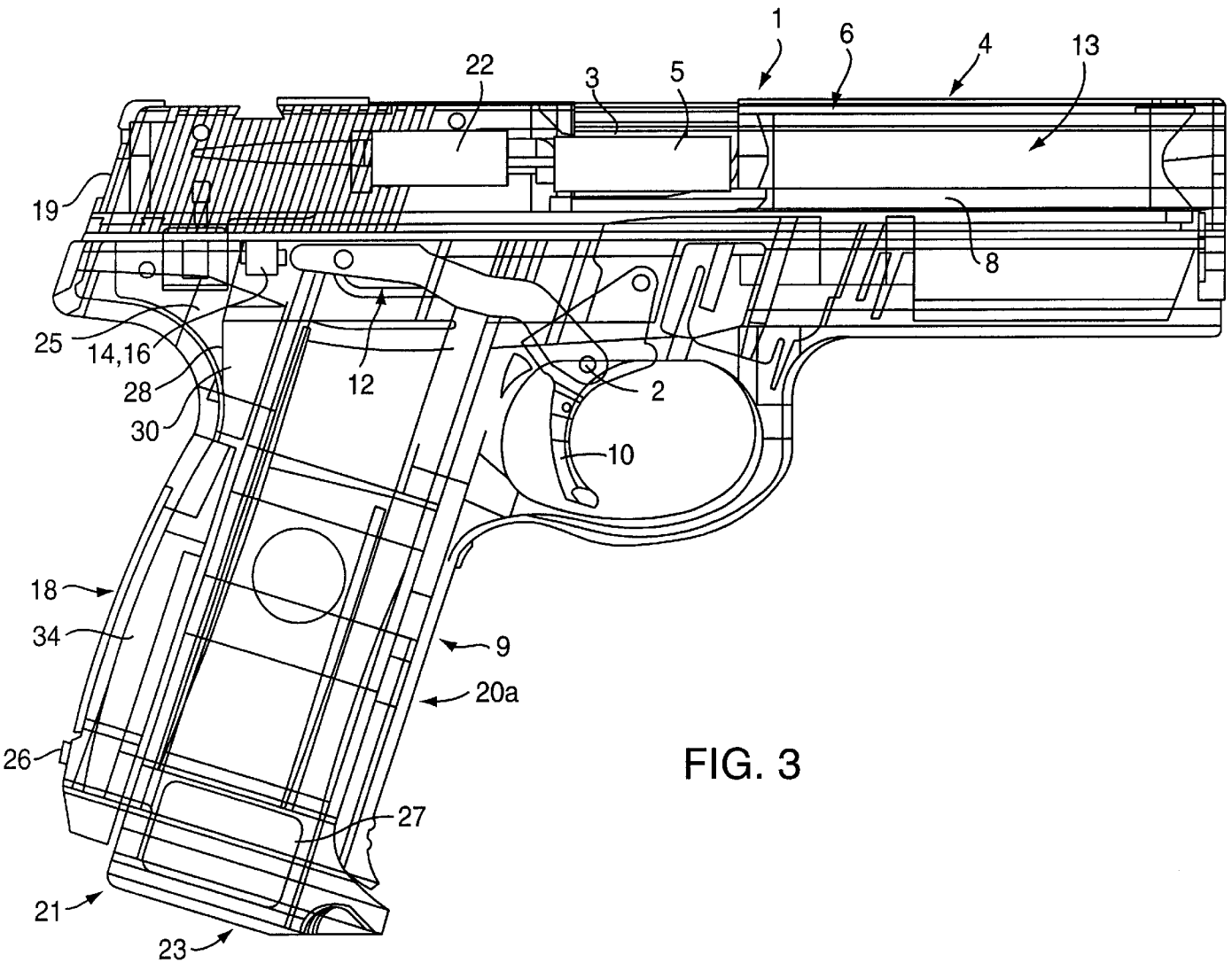
FIG. 3 is an elevational view of a pistol having an electronic fire control system of the present invention.

Referring now to FIG. 3, a first embodiment of the firearm of the invention is a pistol 1, more specifically comprising a unitary polymer frame 4, a trigger 10 pivotable about a transverse pin 2 rearwardly to move a trigger bar 12, or other transfer device, which is operably connected to trigger switches 14,16. The frame 4 is adapted to receive a metal slide 6 removably fitted into the frame for slidable reciprocal movement therealong. The slide 6 is secured for such movement by longitudinally spaced pairs of metal rails 8 partially embedded in the polymer of the frame. The rails provide durable metal-to-metal contact and may be used as a system ground for the electronic fire control system. Alternatively, a metal pin embedded in the firearm frame can be used for the same purpose. A chamber 3 is disposed within the breech end of a barrel 13 that is housed in the forward portion of the slide 6 and interfits within a recess provided in the upper portion of the frame 4 to hold the barrel 13 in a given longitudinal position relative to the slide 6. An ignition probe 22 is adapted to move longitudinally within the barrel 13 to make electrical contact with the electrically ignitable ammunition 5 in the chamber 3. An information display 19 is disposed at the rearward portion of the frame for displaying critical information to the user such as ready-to-fire, low battery power and diagnostic information A portion of the frame comprises a handgrip 9 that extends downwardly and rearwardly relative to the longitudinal axis of the bore or barrel and forward portion of the frame 4. The handgrip 9 has a pressure sensitive rear grip sensor 18 disposed at the rear portion of the handgrip to detect that the firearm is being handled. A front grip sensor 20*a* is optional and is located on the front of the handgrip 9. The handgrip 9 has a central cavity or magazine well 21 for receiving a magazine 23 that contains the unfired ammunition. The magazine 23 also contains a primary battery 27 which provides power to the electronic circuitry. Also located within one or more auxiliary cavities 25 within the handgrip and frame is the electronic fire control system 28, having a micro-controller 30, and a user authorization device, preferably an embedded fingerprint authorization apparatus 34. In the preferred embodiment a slot 26 for reading the fingerprint pattern of an authorized user is located in the back-strap area of the handgrip 9.

Figure 4A:
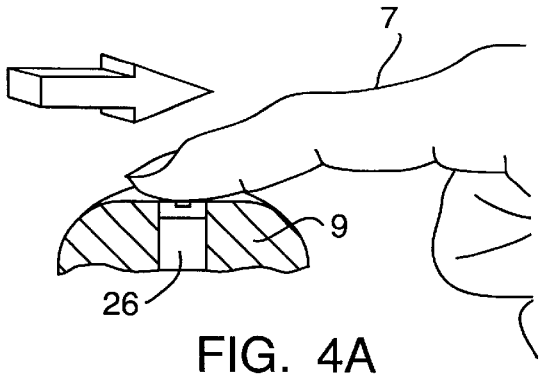
FIG. 4A is a schematic illustration of a fingerprint apparatus provided with the firearm of FIG. 3.
Figure 4B:
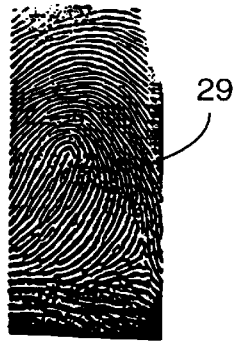
FIG. 4B is a typical fingerprint pattern read by the fingerprint apparatus of FIG. 4.

As shown in FIG. 4A, in the firearm of the present invention, a finger 7 or thumb is swept horizontally across a slot 26 in the handgrip 9 of the firearm, and a fingerprint pattern, 29 such as that shown in FIG. 4B, is read by the finger-print authorization apparatus 34 and compared to prestored patterns. In the preferred embodiment the finger or thumb can be swept either right to left or left to right to allow for ambidextrous use.

Figure 5:
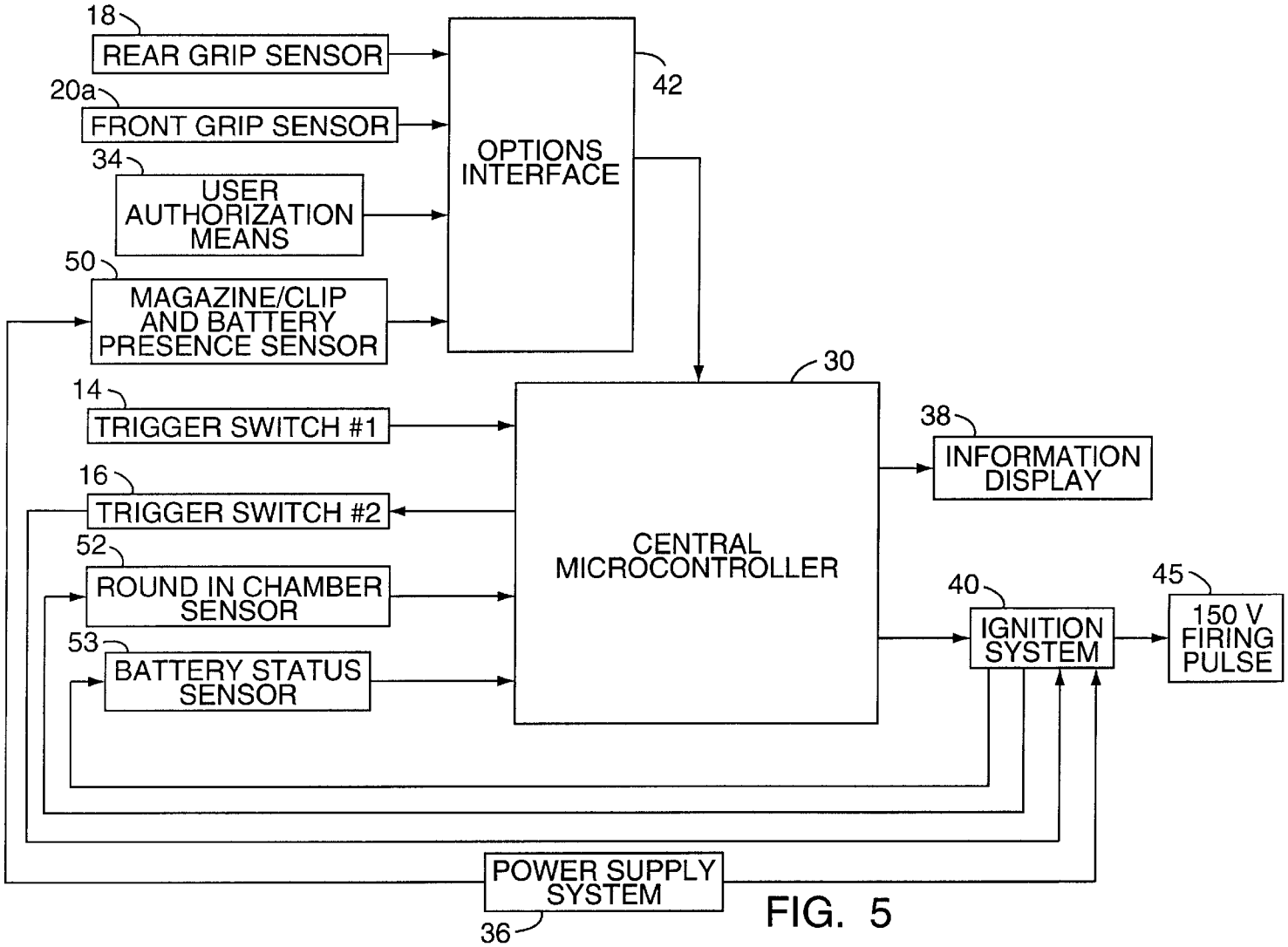
FIG. 5 is a block diagram of an electronic control system of the present invention.

FIG. 5 is a block diagram of the electronic control system of the present invention. As more fully described below, the electronic control system includes a microcontroller 30, capable of receiving external inputs from a plurality of sensors, an options interface 42 capable of interfacing with at least four additional sensor inputs, a power supply system 36, an information display system 38, and an ignition system 40 which provides the 150 Vdc firing pulse 45 to the electrically ignitable ammunition 5. In the preferred embodiment the microcontroller 30 is operably connected to trigger switches 14, 16, a Round-In-Chamber sensor 52 and a battery status sensor 53. The options interface 42 receives inputs from the rear grip sensor 18, the front grip sensor 20*a*, a magazine/battery (or clip/battery depending on the embodiment) presence sensor 50 and a user authorization device. The user authorization device is an important aspect of the present invention. Although the user authorization device may be an embedded fingerprint apparatus 34, as described herein, other user authorization devices, such as an RF scanner, a combination lock, or an electronic key, can be implemented to perform the same function.

Referring still to FIG. 5, the microcontroller 30 is preferably an 8-bit Microchip® PIC16C715, or equivalent, which is normally in a SLEEP, or power saving, mode when the firearm is not in use, and 'wakes up' when an external interrupt from a grip sensor, or other sensing means, detects that the firearm is being handled. The microcontroller, with integrated analog-to-digital (A/D) converters, 2K bytes of program memory (EPROM), 128 bytes of data memory (RAM) and 13 I/O pins, coordinates the timing and execution of all events, and is programmed, as more fully described below, to enable firing only upon verification of authorized firing status. In the preferred embodiment, the options interface 42 is a four channel analog to digital interface integrated into the Microchip® microcontroller. There are numerous alternative devices, however, with quite different memory and I/O configurations that would be equally useful in the present application.

Figure 6:
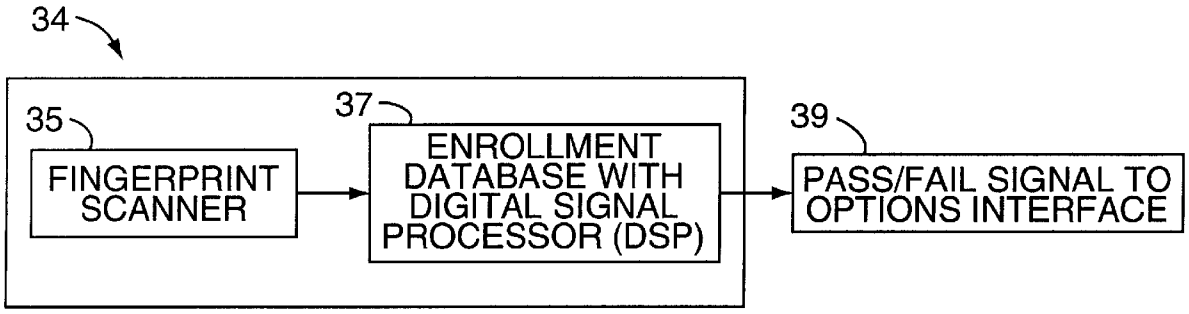
FIG. 6 is a block diagram of a preferred embodiment of a user authorization device adaptable for use with the present invention.

As shown in FIG. 6., the user authorization device is preferably an embedded fingerprint apparatus 34 comprising a scanning element 35, such as the Thomson-CSF FingerChip)™ FC15A140 fingerprint reader, and an Enrollment Database having a Digital Signal Processor (DSP) 37 programmed to compare and match the fingerprint pattern read by the scanning element 35 to previously stored patterns. The DSP 37 transmits a pass/fail signal 39 to the microcontroller 30 through the options interface as depicted in FIG. 5. Scanning, image processing, and verification preferably occurs in user perceived real time (less than 50 msec). Like the microcontroller 30, the embedded fingerprint apparatus is in a SLEEP mode to conserve power when not in use.

Figure 7:
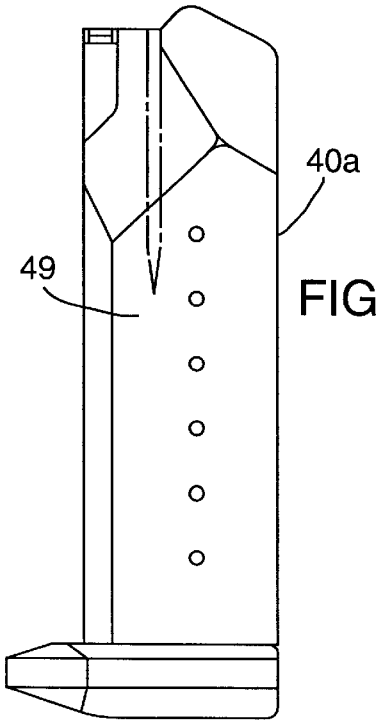
FIG. 7 is an elevational view of a mock magazine used as an authorization key.
Figure 7B:
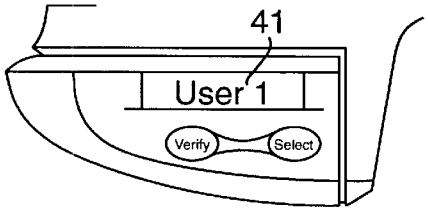
FIG. 7B is a schematic illustration of an alternative embodiment of the selector switches of FIG. 7A.
Figure 7A:
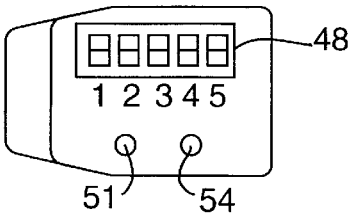
FIG. 7A illustrates a series of selector switches positioned on a bottom surface of the mock magazine show in FIG. 7.

Enrollment of an authorized fingerprint requires the use of an authorization key. FIG. 7 is a schematic illustration of an authorization key 40*a*. In the preferred embodiment, the authorization key is a mock magazine or clip having a fixed electronic password that is communicated to the central microcontroller 30 through an RF non-contact proximity interface 49 or through a direct connection. In the preferred embodiment, up to five fingerprints can be authorized for one firearm, allowing the user to choose between enrolling several fingers on either hand, or to enroll other authorized users. Positioned on the bottom of the authorization key 40*a* are a plurality of enrollment selector switches 48 and two LEDs 51,54 to indicate the success or failure of the enrollment attempt, as depicted in FIG. 7A. Other embodiments of the enrollment selector switches 48, using a single LED or buttons or using a Liquid Crystal Display 41, as shown in FIG. 7B, for example, will occur to those skilled in the art. The electronic control is programmed to identify a valid password and verify that the chamber is unloaded and the firing circuitry disabled during the enrollment process.

Figure 8:
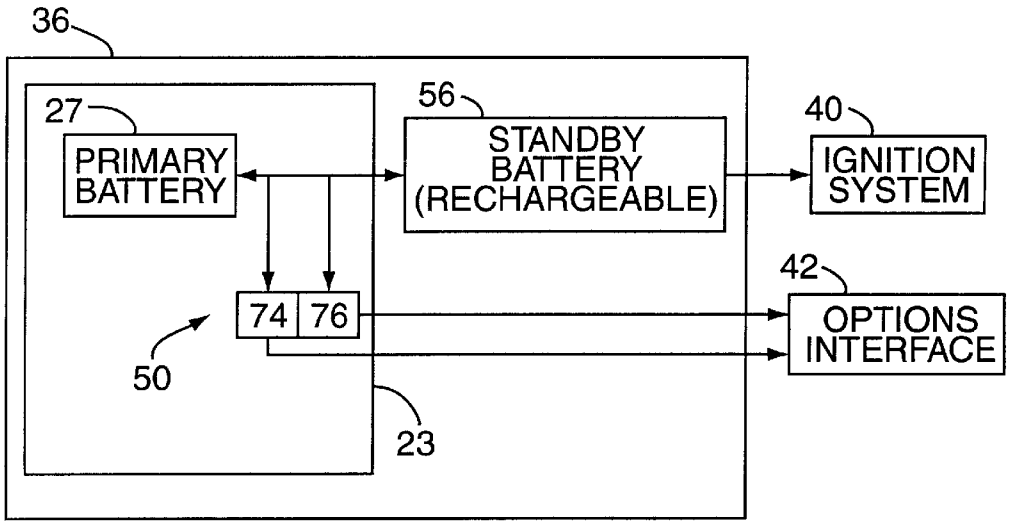
FIG. 8 is a block diagram of a power supply system of the electronic control system of the present invention.

Referring now to FIG. 8, the power supply system 36 of the present invention is shown schematically. Power to the ignition system 40 for firing the electrically ignitable primer 24 and for all other system requirements is derived from the primary battery 27, and a secondary or standby battery 56. In the preferred embodiment, the primary battery 27 is a 3 volt DC lithium battery disposed at the bottom of the ammunition magazine or clip 23. Because the primary battery 27 is removed with the magazine/clip 23, a secondary standby power source is provided to enable the microcontroller to perform minimal self-test and display functions when the magazine/clip 23 is removed. In the preferred embodiment, the standby battery 56 is a small rechargeable cell which is recharged when the magazine/clip 23 is placed in the firearm. Other power sources having comparable temperature performance range, power density, and shelf life can also be used.

A battery presence sensor 50 comprising two pairs of contacts 74 and 76 between the magazine/clip and the firearm frame detects the presence of the battery. A closed circuit in both pairs of contacts 74, 76 indicated that the magazine/clip has been inserted into the magazine well or central cavity 21 of the firearm. When the magazine/clip 23 is removed, an open circuit between the firearm frame 4 and the magazine/clip 23 at contacts 74 and 76, signifies the absence of the magazine/clip 23 and causes the microcontroller 30 to disable the fire control system according to the logic flow chart depicted in FIG. 17. When the magazine or clip 23 is removed, a round in the chamber cannot be discharged. The signal from the battery presence sensor 50 is transmitted to the microcontroller 30 through the options interface 42 as shown. Those skilled in the art will recognize that several other embodiments of the battery presence sensor 50 are possible.

Figure 9:
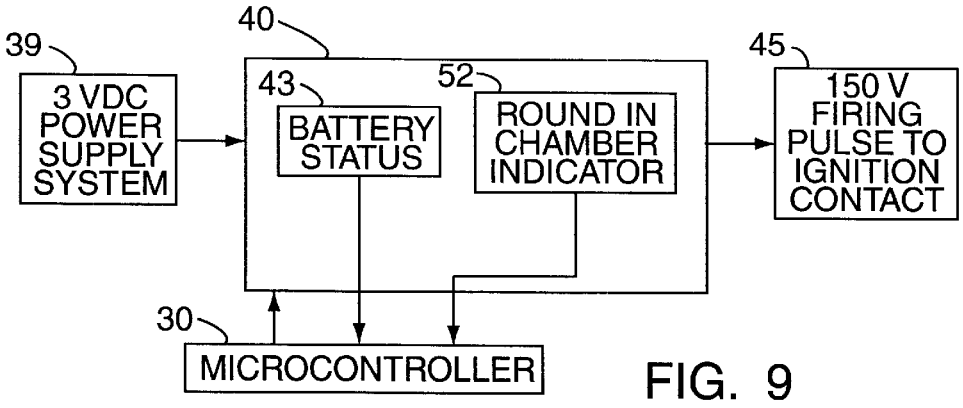
FIG. 9 is a block diagram of an ignition system of the electronic control system of FIG. 5.

FIG. 9 is a schematic illustration of the Ignition System 40 of the present invention. Using conventional techniques, the ignition system 40 converts the low level dc input from the batteries in the power supply system 36 to a 150 Vdc firing pulse 45 of sufficient duration, preferably one millisecond minimum, to fire the electrically ignitable ammunition. In the preferred embodiment, 150 Vdc is stored across 4.7 $\mu$f capacitor that is discharged when the microcontroller 30 transmits a one millisecond fire enable signal to the ignition system 40. Unlike an ignition system in a bolt action rifle, for example, in the ignition system of the present invention, the capacitor must be able to be recharged and ready to fire again within a minimum of 150–200 milliseconds.

In the preferred embodiment, the trigger 10 simultaneously activates two high reliability sealed micro-switches within the electronic control system. The first micro-switch signifies to the microcontroller 30 that a decision to fire has been made. The output of the first micro-switch is debounced using an integrator circuit before it is input to the microcontroller 30 in order to prevent unintentional activation of the fire enable signal. When the microcontroller 30 detects a valid trigger signal from the first micro-switch, a fire enable signal in the form of a one millisecond square wave is transmitted by the microcontroller 30 to the ignition system 40 through the second micro-switch. The width of the square wave transmitted to the ignition circuit corresponds to the duration of the 150 vdc firing pulse applied to the electrically ignitable ammunition. Use of the second micro-switch provides a measure of redundancy to ensure against a false trigger signal resulting from a switch failure or other system malfunction.

In the preferred embodiment, ignition is inhibited by the control logic for at least 150 milliseconds between rounds. The 150 millisecond cycle time is designed to ensure that any unintentional trigger activity that may occur due to recoil, hesitation or inertia is ignored by the ignition system 40. The 150 milli-second cycle time provides a measure of safety without affecting performance since, typically, even an exceptionally skilled user cannot intentionally shoot faster than 200 milliseconds between rounds.

Those skilled in the art will recognize that several alternative trigger switching methods may be utilized as well. One such method is to use a Giant Magnetoresistive (GMR) sensor to determine the position of a metal linkage operably connected to the trigger. Such a GMR sensor, used in combination with a single trigger switch, can be implemented to provide a precise and fail-safe fire enable signal to the ignition system. Other alternative methods that will occur to those skilled in the art involve the use of piezoelectric or strain gage devices.

Figure 12:
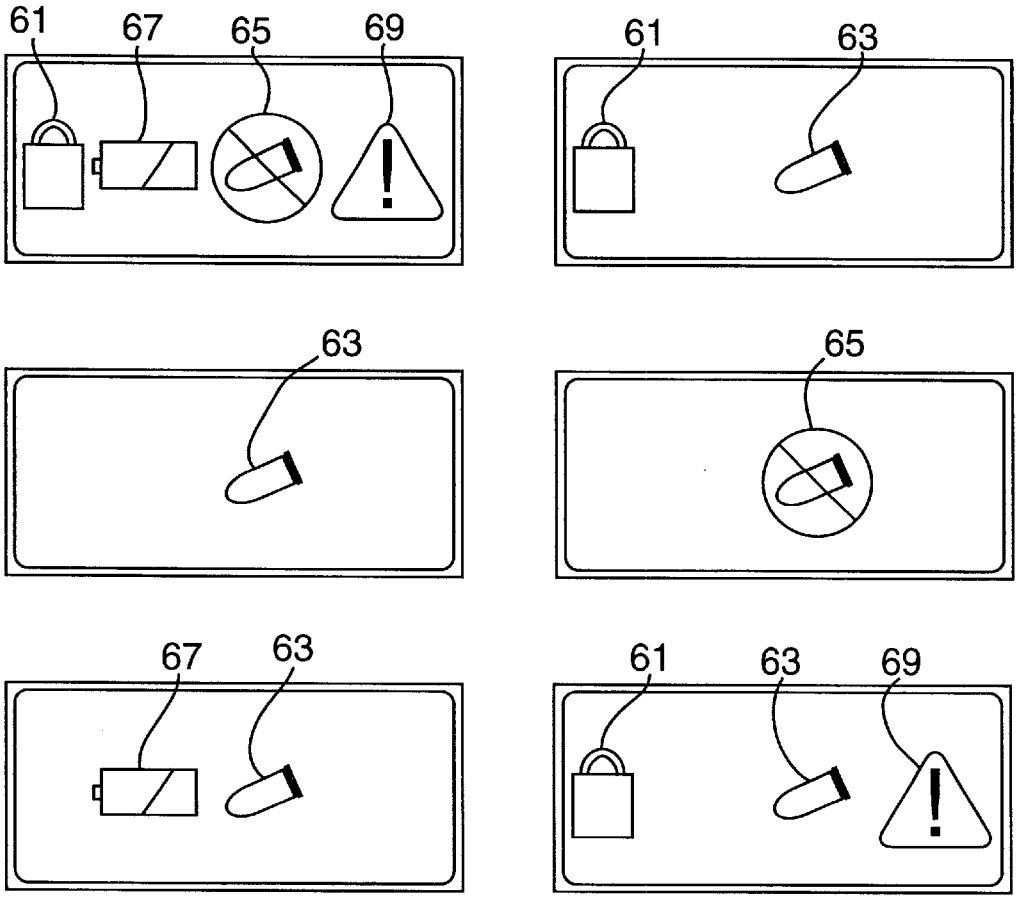
FIG. 12 depicts icons used by the information display system of FIG. 11.

The ignition system 40 described above is based on ignition by capacitive discharge. Other embodiments of an ignition system capable of delivering firing energy to the electrically ignitable primer in user perceived real time will occur to those skilled in the art. One such alternative is a two stage ignition system, in which the first stage is a pulse width modulated discontinuous dc-to-dc converter and the second stage is a pulse generator capable of generating pulses of sufficient voltage and duration to fire the electrically ignitable ammunition In the preferred embodiment, the ignition system 40 incorporates circuitry to detect the power remaining in the battery. A signal representing a battery status 43 signal is transmitted from the ignition system 40 to the microcontroller 30 which is programmed to provide a low battery warning to the user sufficiently in advance of the time the battery must be replaced in order to enable the firearm to function for an extended period of time on battery reserves. In the preferred embodiment, the low battery warning is indicated by a message or icon on the information display 19 as shown in FIG. 12.

Figure 17:
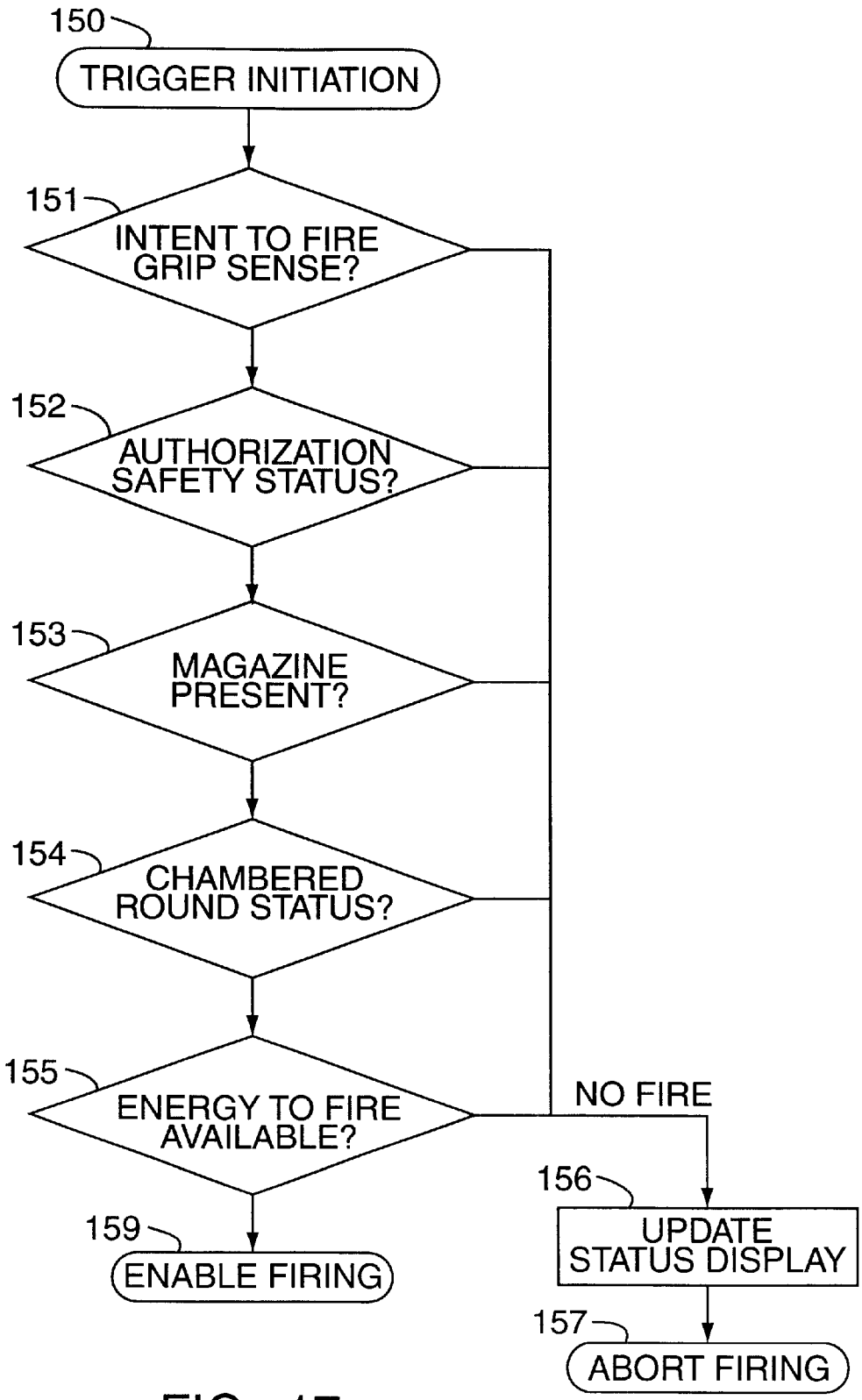
FIG. 17 depicts a Trigger Initiation algorithm used with the control algorithm of FIG. 13.

Referring still to FIG. 9, the ignition system 40 also incorporates a Round-In-Chamber sensor 52 for detecting the presence or absence of a chambered round. Detection of a chambered round is accomplished by sensing the impedance of the connection between the ammunition and the firing circuit using a low voltage (below the no-fire threshold) sensing current. To optimize energy transfer and power conservation, the duration of the firing pulse can be adjusted based on the impedance of the chambered round. A signal from the Round-in-Chamber sensor 52 is transmitted to the microcontroller 30 which is programmed, as shown in FIG. 17 below, to read and integrate all sensor data and display the appropriate icon (See FIG. 12) on the information display 19 to inform the user as to the presence or absence of a chambered round.

By detecting the impedance of the connection between the ammunition and the firing circuit, the Round-In-Chamber sensor 52 also permits the detection of a present but defective round prior to firing. The Round-In-Chamber sensor 52 can, therefore, warn the user of worn, defective, or contamination build-up within the firearm. The microcontroller 30 is programmed to disable firing in the event a defective round is detected.

Figure 10:
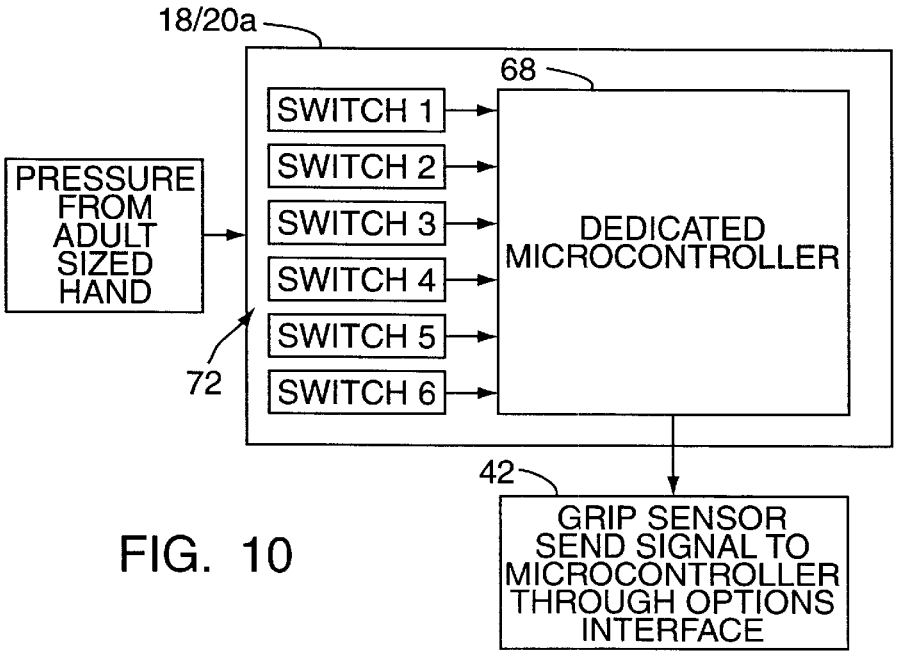
FIG. 10 is a block diagram of a rear grip sensor utilized with the present firearm.

FIG. 10 depicts the Rear Grip Sensor 18 schematically. An optional Front Grip Sensor can be implemented in substantially the same manner. As noted above, when the firearm is not in use, the electronic control system 20 is in a suspended SLEEP mode to conserve power. The firearm 'wakes up' when the pressure sensitive Front or Rear Grip sensor 18/20*a* detects the firearm is being handled and sends an interrupt to the microcontroller 30 through the options interface 42. In the preferred embodiment, the Rear Grip Sensor 18 comprises a plurality of switches 72 arrayed along the backstrap area of the firearm as shown in FIG. 3. In addition to providing a 'wake up' function, the rear grip sensor 18 has a dedicated microcontroller 68, preferably a Microchip® PIC 16C71574 or equivalent, programmed to read the pattern of signals from the switches 72 and determine if the firearm is being handled with an intent to fire. A firm grip, adequate to keep the firearm under control during discharge, must be sensed by the Rear Grip Sensor 18 in order to fire. Firing is therefore disabled if the firearm is being handled by a child or someone with a very poor or unintentional grip.

Figure 11:
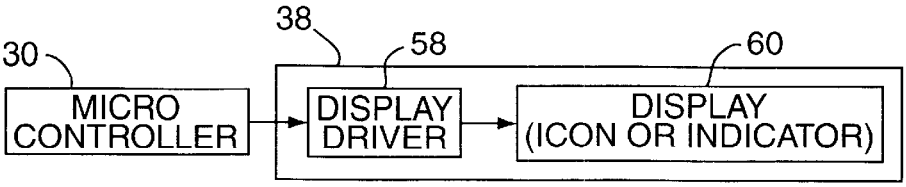
FIG. 11 is a block diagram of an information display system utilized in the firearm of the present invention.

Referring to FIG. 11, the information display system 38 of the firearm is depicted schematically. Through the information display system 38, information on a variety of system parameters, including battery status, Round-In-Chamber status, or ready-to-fire status, for example, is presented to the user. The information display system 38 comprises generally an information display 19 and a display driver 58. The information display 19 can be implemented using a combination of a low power, always active, Liquid Crystal Display (LCD) for icons depicting system parameters and a Light Emitting Diode (LED) for a ready-to-fire light. The display driver 58 is programmed to load preset messages to the information display 19 based on control signals received from the microcontroller 30 and is preferably a dedicated microcontroller, such as the Microchip® PIC16C715. Other embodiments of the information display system 38 will occur to those skilled in the art.

The information display system 38 preferably uses a simple set of internationally understood icons, as depicted in FIG. 12. A padlock 61 indicates the system will not fire because an unauthorized user is handling the firearm. A flashing padlock indicates the firearm is awaiting authorization. A bullet icon, which can be displayed alone 63 or with a line through it 65, signifies whether a live round is in the chamber. A bullet icon with a red LED indicates that a live round is in the chamber and the firearm is authorized and capable of firing. A battery icon 67 is used to signify low battery power. A triangle with an exclamation point 69, or alternatively, all icons flashing, symbolizes a system malfunction has been detected.

Figure 13:
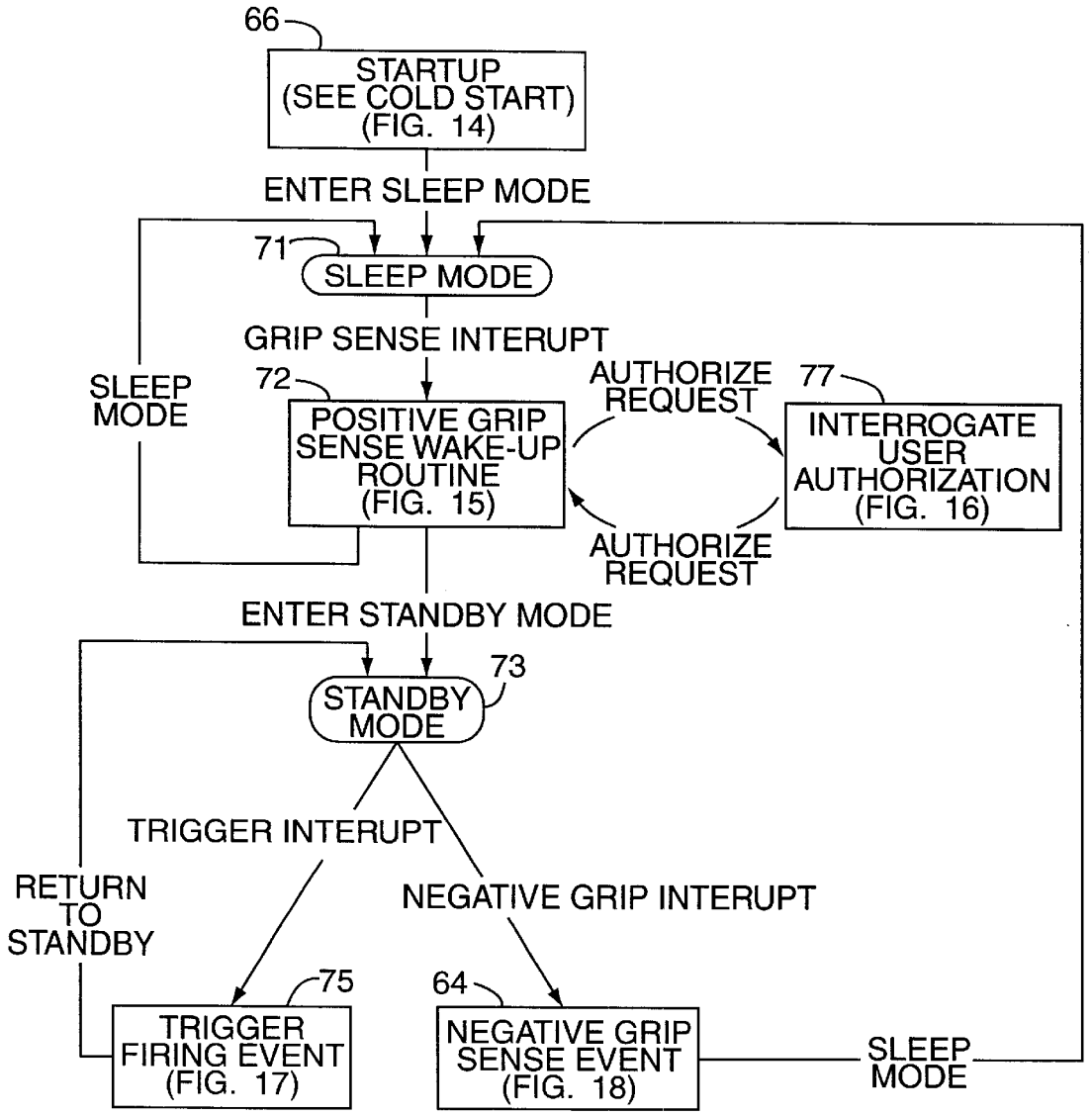
FIG. 13 is a high level block diagram of a control algorithm used with the present firearm.

Referring to FIG. 13, a high level block diagram of the control logic 70 of the present invention is depicted. As shown, the firearm is normally in either a SLEEP mode 71 or a STANDBY mode 73 unless the firearm is undergoing a cold start 66 which occurs when the firearm is used for the first time or the batteries are replaced. A cold start algorithm is depicted in FIG. 14 below.

Figure 15:
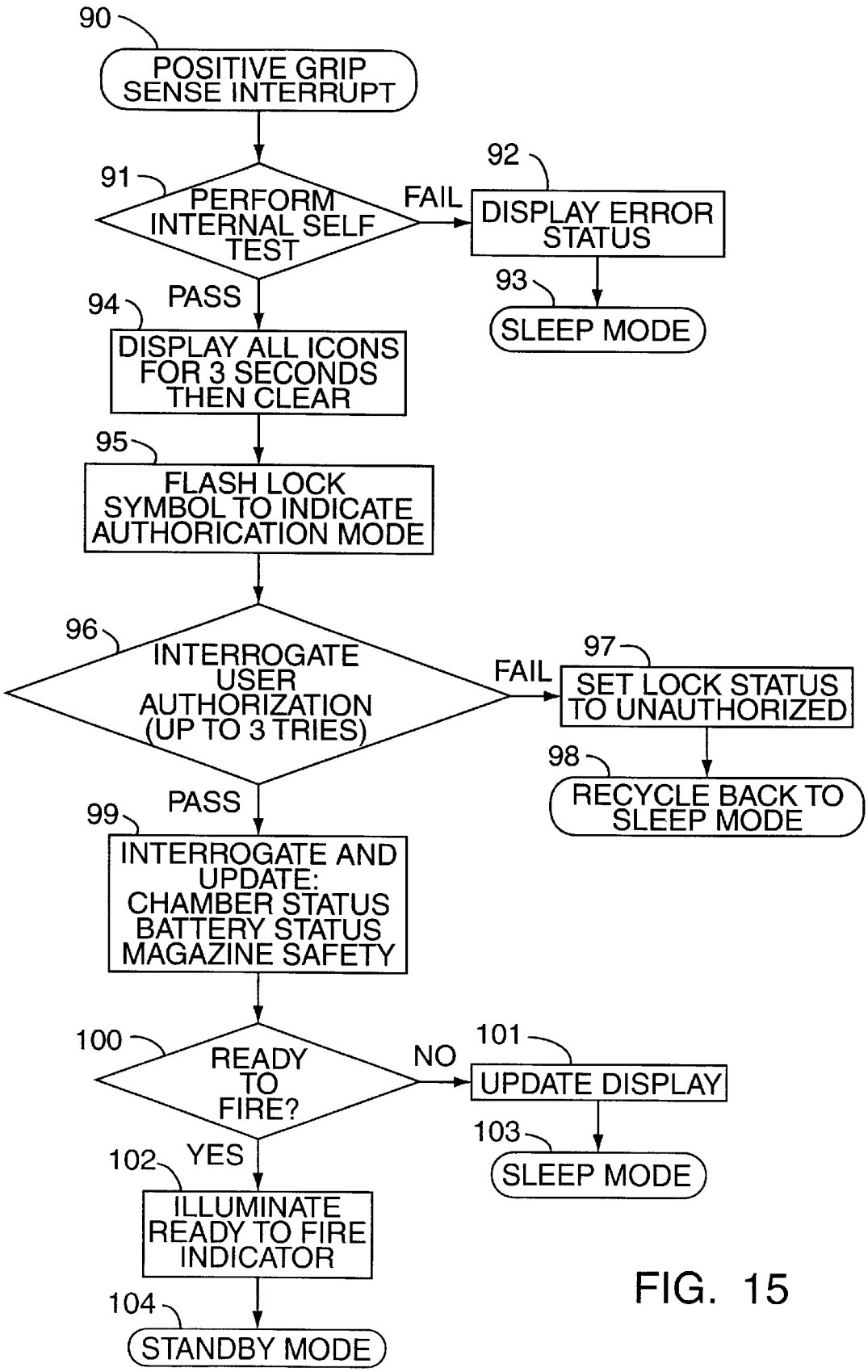
FIG. 15 depicts another algorithm used with the control algorithm of FIG. 13, when a positive grip sense interrupt is detected.

Referring still to FIG. 13, the transition from SLEEP mode to STANDBY mode occurs when a grip sense interrupt is detected by the microcontroller, which event causes the firearm to go through a "Positive Grip Sense Wake-Up" algorithm (Block 78 and FIG. 15). The firearm will transition to the STANDBY mode only if a "User Authorization" algorithm (Block 77 and FIG. 16) is successfully completed. Once in STANDBY mode 73, the firearm will fire when a "Trigger Firing Event" (Block 75 and FIG. 17) occurs. If the firearm is in STANDBY mode and the microcontroller detects a "Negative Grip Sense Event" (Block 64 and FIG. 18), the firearm will return to SLEEP mode 71 as shown.

Figure 14:
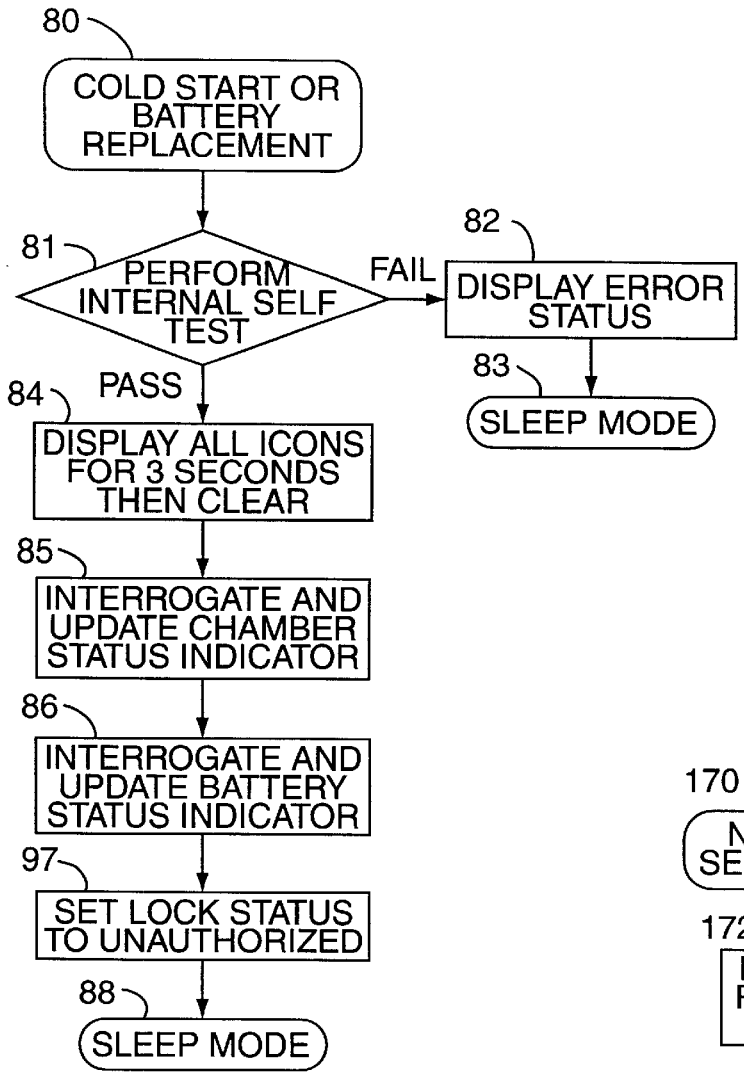
FIG. 14 depicts an algorithm for a cold start routine used in the control algorithm of FIG. 13.

Referring to FIG. 14, the algorithm for a cold start or battery replacement routine is shown. The cold start algorithm 80 is followed if the firearm has never been used or the battery is replaced. As shown, the control logic first performs an internal self-test 81. If a fault is detected an error indicator will be displayed 82 and the firearm will enter SLEEP mode 83. If the internal self-test is successful, all icons on the information display will be displayed for approximately three-seconds 84, the Round-in-Chamber and the battery status will be updated, 85 and 86 respectively, the firearm status will be set to UNAUTHORIZED 97 and the firearm will enter SLEEP mode 88. As programmed, firing is disabled during the cold start algorithm 80.

Figure 16:
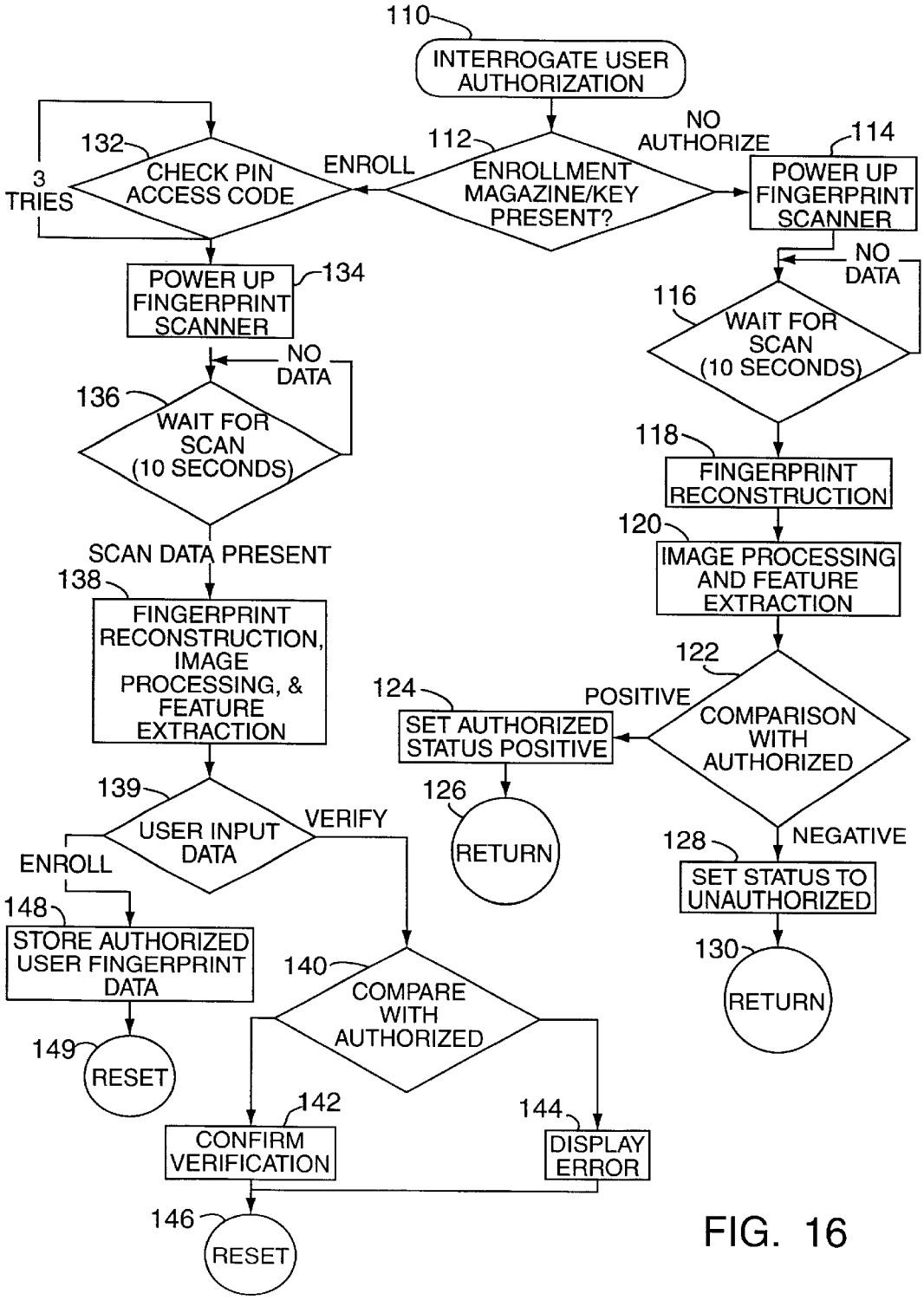
FIG. 16 depicts a User Authorization algorithm used with the control algorithm of FIG. 13.

Referring to FIG. 15, when a positive grip sense interrupt 90 is detected, the electronic fire control system will first perform an internal self-test 91. If the self-test routine detects a system fault a system malfunction symbol will be displayed 92 and the firearm will revert to SLEEP mode 93. If the self-test is successful, all icons will be displayed for approximately three-seconds 94 and the padlock symbol on the information display will flash 95 as the User Authorization algorithm 96 depicted in FIG. 16 is performed. If the User Authorization algorithm cannot be successfully performed for any reason, the firearm status will be set to UNAUTHORIZED 97 and the firearm will revert to SLEEP mode 98. If the user is authorized, as determined by the User Authorization algorithm 96, the control will interrogate and update the Round-in-Chamber status, battery status, and magazine status 99. If the firearm is ready to fire 100, the ready-to-fire indicator on the information display will be illuminated 102 and the firearm will enter STANDBY mode 104. In the event that an error is detected, the display will be updated accordingly 101 and the firearm will revert to SLEEP mode 103. The firearm is programmed not to discharge unless the user has been properly enrolled and authorized according to the algorithm depicted in FIG. 16.

Referring to FIG. 16, the algorithm to Interrogate User Authorization 110 is depicted schematically. As indicated, the control first determines, by the presence or absence of the enrollment key 112, whether the intent of the user is to enroll an authorized user or to authorize a previously enrolled user. If the enrollment authorization key is present, a PIN access code associated with the authorization key is verified 132, the fingerprint scanner is activated 134 for a predetermined time, preferably ten-seconds 136, during which time the finger-print of the user is scanned. From the raw scanned data, the fingerprint image is reconstructed and processed 138 and stored 148 in memory. The algorithm is then reset 149 to the beginning 110.

If the enrollment key 112 is present, the user may verify a previously enrolled fingerprint using the same method. When the fingerprint image has been reconstructed (Block 138) and formatted (Block 139), it is compared with a previously enrolled fingerprint 140 for verification 142 and the algorithm is then reset 146 to the beginning 110. If the fingerprint image does not match, an error message will be displayed 144 on the information display and the algorithm reset as shown 146.

Referring still to FIG. 16, if the enrollment key is not present 112, the firearm is programmed to authorize use only if the user's fingerprint matches a previously stored fingerprint pattern. As shown, the fingerprint scanner is activated 114 for a predetermined period of time, preferably 10 seconds, during which time the fingerprint of the user is scanned 116. The raw scanned data is then reconstructed 118 and processed 120 and compared with previously stored patterns 122. If there is a match, the lock status is set to AUTHORIZED 124 and the firearm returns 126 to the main control program (FIG. 13) and enters STANDBY mode. If there is no match, the lock status is set to UNAUTHORIZED 128, disabling the firearm, as the firearm returns 130 to the main control program (FIG. 13).

FIG. 17 is a schematic illustration of the Trigger Initiation algorithm 150. As shown, when the firearm is in STANDBY mode, ready to fire, and the trigger is pulled, the electronic control polls a series of internal and external parameters including the grip sensors 151, the user authorization signal 152, the magazine presence sensor 153, the round in chamber indicator 154, and the energy available to fire 155. If any system parameters are not in the proper state, the electronic control is programmed to update the information display 156 with the appropriate error message and abort firing 157. If all system parameters indicate the firearm is authorized and ready to fire, a fire enable signal 159 is transmitted to the ignition system to discharge the electrically ignitable ammunition.

Figure 18:
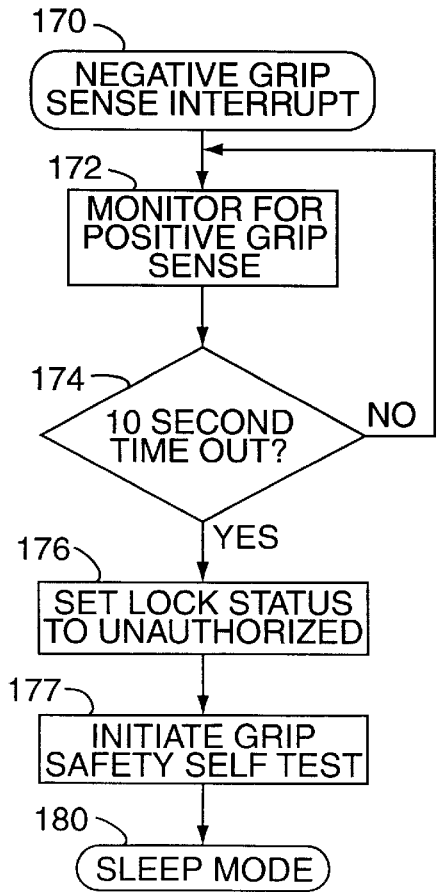
FIG. 18 depicts a Negative Grip Sense algorithm used with the control algorithm of FIG. 13.

Referring to FIG. 18, when the firearm is in STANDBY mode, and the grip sensors detect that the firearm is no longer being handled, the firearm will revert to SLEEP mode as indicated. If a negative grip sense interrupt is received from the grip sensors 170 while the firearm is in STANDBY mode, the electronic control will monitor the input of the grip sensors for a positive grip 172 for a predetermined time, preferably ten-seconds 174, and if a positive grip is not detected, the electronic control will set the lock status to UNAUTHORIZED 176, initiate a grip sensor self-test routine 177 and revert to SLEEP mode 180. In the event that a positive grip sense is detected within the predetermined time, the firearm will return to STANDBY mode, ready to fire.

Figure 19:
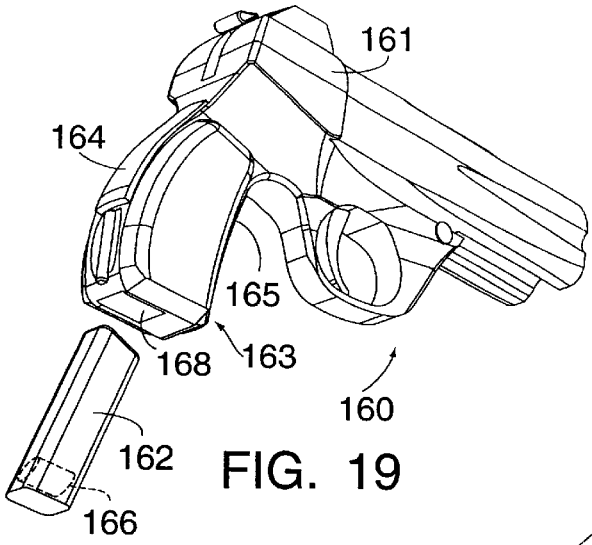
FIG. 19 is a schematic view of a multiple chambered handgun having an electronic fire control system.
Figure 20:
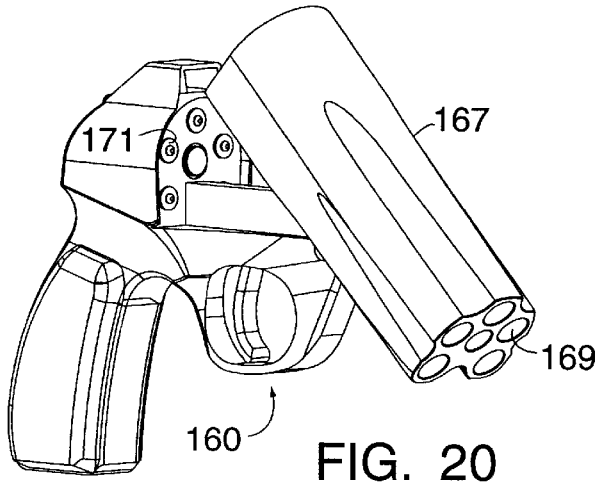
FIG. 20 is a schematic front view of the firearm of FIG. 19 in an 'open' position.
Figure 21:
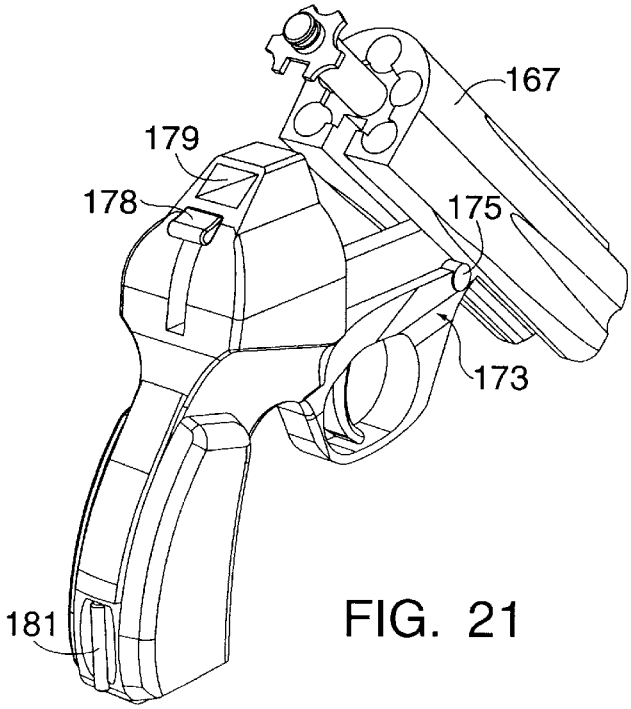
FIG. 21 is a schematic rear view of the firearm of FIG. 19 in an 'open' position.

In a second embodiment, the electronic fire control system, described above, is implemented in a multiple chambered gun depicted in FIGS. 19–21. Referring to FIG. 19, the multiple chambered handgun 160 comprises generally a frame 161 which includes a handle portion 163, having a rear grip sensor 164 and optionally a front grip sensor 165. The handle 163 has a central cavity 168 for receiving a clip 162 that houses the primary battery 166 which provides the primary power to the electronic circuitry.

Referring to FIG. 20, the multi-chambered handgun 160 has a barrel 167 adapted to receive several cartridges within a plurality of longitudinal bores 169. A plurality of ignition probes 171, in axial alignment with the longitudinal bores 169, are positioned to fire the cartridges in a predetermined sequence.

Referring to FIG. 21, the barrel 167 is hinged to the frame through a hinge assembly 173 and is pivotable about a hinge pin 175. When the firearm is 'open', as shown, the empty brass or cartridge cases may be removed, and the firearm reloaded. The barrel 167 may then be swung back into the 'closed', or firing position, and locked with locking mechanism 178. An information display 179 is disposed above the handle as shown. As in the first embodiment, the preferred user authorization means is an embedded fingerprint apparatus 181 located, as shown, in the backstrap area of the handle.

Figure 22:
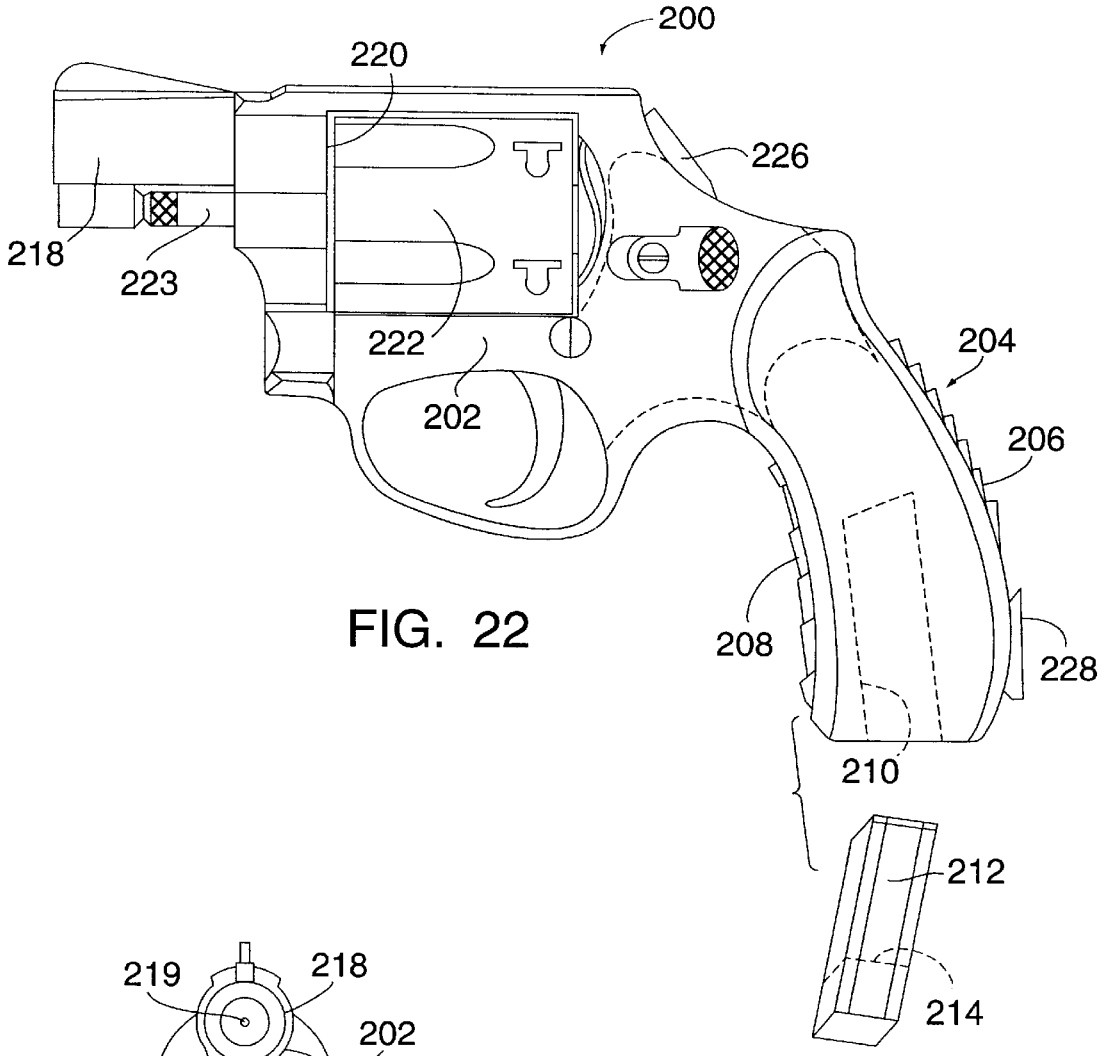
FIG. 22 is a schematic view of a revolver having the electronic control system of the present invention.
Figure 23:
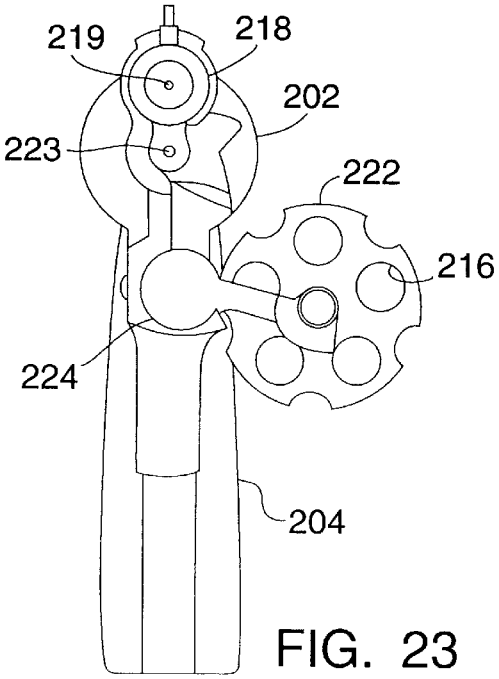
FIG. 23 is a schematic view of the revolver of FIG. 22 in an 'open' position.

In yet another embodiment, the electronic fire control system described above is implemented in a revolver. The revolver embodiment of the present invention is shown generally at FIG. 22. The revolver 200 comprises generally a frame 202 which includes a handle portion 204, having a rear grip sensor 206 and optionally a front grip sensor 208. The handle 204 has a central cavity 210 for receiving a clip 212 which contains a primary battery 214. The revolver 200 has a rectangular opening or window 220 adapted to receive a cylinder 222. An information display 226 is disposed above the handle as shown. As in the other embodiments, a slot 228 for reading the fingerprint of the authorized user is disposed in the backstrap area of the firearm. As shown in FIG. 23, the cylinder includes a plurality of longitudinal bores 216 which are adapted to position, in sequence, cartridges (not shown) to the firing position in axial alignment with the barrel 218 and an ignition probe 219. The cylinder 222 is rotatable about its centerline on a center pin 223. The cylinder 222 is also pivotable on a yoke 224. When the cylinder is 'open', the empty brass or cartridge cases may be removed and the cylinder reloaded. It may then be swung back into the window 220, ready for firing upon determination of safe and authorized firing conditions.

While the present invention has been illustrated and described with respect to a particular embodiment thereof, it should be appreciated by those of ordinary skill in the art, that various modifications to this invention may be made without departing from the spirit and scope of the present invention.

What is claimed is:

1. A security apparatus for a firearm including a frame, a power source, a firing chamber adapted to receive a round of ammunition having a primer oriented adjacent a distal end thereof, and a trigger assembly for selectively initiating communication between an ignition system and said primer, said security apparatus comprising:

an authorization device for selectively generating a pass signal indicating that an operator of said firearm is an authorized operator;

a firearm sensor for selectively generating a control parameter signal indicating an operational mode of said firearm;

an electronically programmable locking device for receiving said pass signal and said control parameter signal, wherein said programmable locking device permits communication between said ignition system and said primer only if said authorization device generates said pass signal and said control parameter signal indicates said firearm is in a standby mode; and wherein said security apparatus is contained in a selectively removable module adapted to be inserted into and removable from said firearm.

2. A security apparatus for a firearm according to claim 1 wherein:

said authorization device includes an authorization sensor for receiving data external to said firearm, said external data being indicative of said operator; and said authorization sensor generating an authorization signal in dependence upon said external data.

3. A security apparatus for a firearm according to claim 2 wherein:

said authorization device includes a database of authorized operators, wherein said authorization device compares said authorization signal to said database and outputs said pass signal to said programmable locking device only if said authorization signal corresponds to one of said authorized operators in said database.

4. A security apparatus for a firearm according to claim 3 wherein:

said authorization device outputs a fail signal to said programmable locking device if said authorization signal does not correspond to one of said authorized operators in said database; and said programmable locking device prohibits communication between said ignition system and said primer in response to receipt of said fail signal.

5. A security apparatus for a firearm according to claim 3 further comprising:

an authorization key for enabling alteration of information corresponding to said authorized operators in said database, said authorization key selectively communicating a predetermined password to said programmable locking device.

6. A security apparatus for a firearm according to claim 2 wherein:

said authorization sensor is a fingerprint scanning device located adjacent a grip portion of said firearm, wherein said fingerprint scanning device is adapted to receive fingerprint images of said operator.

7. A security apparatus for a firearm according to claim 5 wherein:

said programmable locking device permitting said authorization key to alter information corresponding to said authorized operators in said database only if said predetermined password is accepted by said programmable locking device.

8. A security apparatus for a firearm according to claim 5 wherein:

said firearm includes a grip portion having a magazine well for accepting an ammunition magazine therein; and said authorization key selectively integrates with said magazine well, wherein insertion of said authorization key in said magazine well enables communication between said authorization key and said authorization device.

9. A security apparatus for a firearm according to claim 1 wherein:

said firearm sensor comprises a battery sensor for determining whether a battery is present in said firearm;

said battery sensor outputting said control parameter signal indicating that said firearm is in said standby mode when said battery is determined to be present in said firearm; and said battery sensor outputting said control parameter signal indicating that said firearm is in a sleep mode when said battery is determined not to be present in said firearm.

10. A security apparatus for a firearm according to claim 9 wherein:

said battery sensor further comprises an energy detection means for monitoring a power level of said power source to determine whether said power source is equal to or above a predetermined power level;

said battery sensor permitting said output of said control parameter signal indicating that said firearm is in said standby mode when said power level is equal to or above said predetermined power level; and said battery power sensor outputting a warning signal to said operator when said power level is below said predetermined power level.

11. A security apparatus for a firearm according to claim 1 wherein:

said firearm sensor comprises a chamber sensor for determining whether said round of ammunition is present in said firing chamber;

said chamber sensor outputting said control parameter signal indicating that said firearm is in said standby mode when said round of ammunition is determined to be present in said firing chamber; and said chamber sensor outputting said control parameter signal indicating that said firearm is in a sleep mode when said round of ammunition is determined not to be present in said firing chamber.

12. A security apparatus for a firearm according to claim 11 wherein:

said chamber sensor further determines a defective state of said round of ammunition present in said firing chamber by evaluating a voltage drop across said round of ammunition; and said programmable locking device prohibits communication between said ignition system and said primer when said voltage drop indicates that said round of ammunition is defective.

13. A security apparatus for a firearm according to claim 1 wherein:

said firearm sensor comprises a grip sensor for determining whether said operator is gripping said firearm with an intent to fire;

said grip sensor outputting said control parameter signal indicating that said firearm is in said standby mode when said operator is determined to be gripping said firearm with said intent to fire; and said grip sensor outputting said control parameter signal indicating that said firearm is in a sleep mode when said operator is determined not to be gripping said firearm with said intent to fire.

14. A security apparatus for a firearm according to claim 13 wherein:

said grip sensor comprises an integrated array of sensors positioned about an exterior surface of a grip portion of said firearm.

15. A security apparatus for a firearm according to claim 13 wherein:

said programmable locking device prohibits communication between said ignition system and said primer when said firearm is in said sleep mode.

16. A security apparatus for a firearm according to claim 1 wherein:

said firearm sensor comprises a battery sensor for determining whether a battery is present in said firearm and if said battery is above a predetermined power level, a chamber sensor for determining whether said round of ammunition is present in said firing chamber and if said round of ammunition is defective, and a grip sensor for determining whether said operator is gripping said firearm with an intent to fire; and said firearm sensor outputs said control parameter signal indicating that said firearm is in said standby mode only when said battery sensor determines that said battery is present in said firearm and is above said predetermined power level, and said chamber sensor determines that said round of ammunition is present in said firing chamber and is not defective, and said grip sensor determines that said operator is gripping said firearm with said intent to fire.

17. A security apparatus for a firearm according to claim 1 wherein:

said programmable locking device maintains said firearm in a sleep mode when said firearm is not in said standby mode; and said programmable locking device prohibits communication between said ignition system and said primer when said firearm is in said sleep mode.

18. A security apparatus for a firearm according to claim 1 wherein:

said programmable locking device verifies that said authorization device is generating said pass signal and said control parameter signal is indicating that said firearm is in said standby mode, before said ignition system is permitted to generate a firing signal in response to an actuation of said trigger assembly.

19. A security apparatus for a firearm according to claim 16 wherein:

said programmable locking device verifies that said authorization device is generating said pass signal, before permitting communication of a firing signal to said primer in response to an actuation of said trigger assembly; and said programmable locking device verifies that said battery sensor continues to determine that said battery is present in said firearm and is above said predetermined level, said chamber sensor continues to determine that said round of ammunition is present in said firing chamber and is not defective, and said grip sensor continues to determine that said operator is gripping said firearm with said intent to fire, before permitting communication of a firing signal to said primer in response to an actuation of said trigger assembly.

20. A security apparatus for a firearm according to claim 1 wherein:

said trigger assembly initiates communication of a firing signal from said power source to said primer in response to an actuation of said trigger assembly; and said programmable locking device prohibits communication of a successive firing signal within a predetermined time period after initiation of said firing signal.

21. A security apparatus for a firearm according to claim 20 wherein:

said predetermined time period is approximately 150 milliseconds.

22. A security apparatus for a firearm according to claim 1 wherein:

said programmable locking device is a microprocessor having volatile and non-volatile memory sections.

23. A method of operation for a security apparatus of a firearm, said method comprising the steps of:

initiating a cold start routine thereby beginning a preliminary sequence of procedures, said cold start routine indicating one of a battery replacement and a first time handling of said firearm;

performing a self-diagnostic test to determine the integrity of various firearm components;

disabling a firing capability of said firearm regardless of a result of said self-diagnostic test; and establishing a sleep mode in which said security apparatus is inactive until an interrupt signal is received corresponding to a signal indicating that a body of said firearm has been engaged by an operator.

24. The method of operation for a security apparatus of a firearm according to claim 23, said method further comprising the steps of:

displaying the results of said self-diagnostic test on a display apparatus;

detecting if a round of ammunition is in a firing chamber of said firearm and displaying a corresponding indicator on said display apparatus; and detecting if a power source of said firearm has a predetermined amount of energy and displaying a corresponding indicator on said display apparatus.

25. A method of operation for a security apparatus of a firearm, said method comprising the steps of:

establishing a sleep mode in which said security apparatus is inactive until an interrupt signal is received, said firearm being incapable of firing when said firearm is in said sleep mode;

detecting the pressure of an operator's grip on said firearm and outputting said interrupt signal in dependence thereon;

determining whether said firearm is in a ready to fire status;

enabling a firing capability of said firearm in response to a positive determination of said ready to fire status, and reestablishing said sleep mode in response to a negative determination of said ready to fire status; and initiating a firing signal in response to actuation of a trigger assembly when said firearm is in said ready to fire status.

26. The method of operating a security apparatus of a firearm according to claim 25, said method further comprising the steps of:

performing a self-diagnostic test to determine the integrity of various firearm components; and displaying the results of said self-diagnostic test on a display apparatus.

27. The method of operating a security apparatus of a firearm according to claim 26, said determination of said ready to fire status comprising the steps of:

performing an authorization routine for determining if said operator is authorized to fire said firearm; and detecting a status of a firearm sensor array for determining if said firearm is prepared to fire.

28. The method of operating a security apparatus of a firearm according to claim 27, said authorization routine comprising the steps of:

initiating operation of a fingerprint scanner integral to said firearm;

receiving an image of said operator's fingerprint and generating an input signal thereby;

comparing said input signal to a prestored signal corresponding to an authorized operator; and authorizing said operator to fire said firearm if said input signal corresponds to said prestored signal.

29. The method of operating a security apparatus of a firearm according to claim 27, said authorization routine comprising, the steps of:

determining if an authorization key has been integrated with said firearm, thereby indicating that a new authorized operator may be designated by said security apparatus;

verifying that said authorization key is communicating a predetermined access code to said security apparatus;

enabling operation of a fingerprint scanner integral to said firearm;

receiving an image of said operator's fingerprint and generating an input signal thereby; and storing said input signal as corresponding to one of a plurality of possible authorized operators.

30. The method of operating a security apparatus of a firearm according to claim 27, said detection of said firearm sensor array to comprise the steps of:

detecting if a round of ammunition is in a chamber of said firearm;

detecting if a battery is present in said firearm and has a predetermined amount of power; and detecting if an ammunition magazine is present in said firearm.

31. The method of operating a security apparatus of a firearm according to claim 27, said method further including the steps of:

placing said firearm in said ready to fire status only if said operator is determined to be said authorized operator and said firearm sensor array determines that said firearm is prepared to fire, wherein said sleep mode is otherwise reestablished.

32. The method of operating a security apparatus of a firearm according to claim 25, said method further including the steps of:

determining if said firearm is in said ready to fire status;

detecting the absence of said operator's grip on said firearm;

waiting a predetermined time period to detect the presence of said operator's grip on said firearm; and establishing said sleep mode if said predetermined time period elapses without detecting the presence of said operator's grip on said firearm.

* * * * *